US005351111A

United States Patent [19]

Takafuji et al.

[11] Patent Number: 5,351,111

[45] Date of Patent: Sep. 27, 1994

[54] CORONA DISCHARGE DEVICE

[75] Inventors: Akihiro Takafuji; Osamu Shimizu, both of Kanagawa, Japan

[73] Assignee: Fuji Xerox Co., Ltd., Tokyo, Japan

[21] Appl. No.: 142,990

[22] Filed: Oct. 29, 1993

[30] Foreign Application Priority Data

Oct. 30, 1992 [JP] Japan ..... 4-293335

[51] Int. Cl.[5] ..... G03G 15/02

[52] U.S. Cl. ..... 355/221; 250/324; 355/219; 355/225; 361/225

[58] Field of Search ..... 355/219, 221, 224, 225; 361/225; 250/324, 325, 326

[56] References Cited

U.S. PATENT DOCUMENTS

| | | | |
|---|---|---|---|
| 4,335,420 | 6/1982 | Mitsuo et al. | 361/230 |
| 4,652,754 | 3/1987 | Almeter et al. | 250/325 |
| 4,792,680 | 12/1988 | Lang et al. | 250/325 |
| 4,876,578 | 10/1989 | Hara et al. | 355/315 |
| 4,984,018 | 1/1991 | Andou et al. | 355/200 |
| 5,025,155 | 6/1991 | Hattori | 250/326 |
| 5,105,223 | 4/1992 | Bergen | 355/225 |
| 5,206,784 | 4/1993 | Kimiwada et al. | 361/229 |
| 5,245,502 | 9/1993 | Genovese | 361/225 |
| 5,257,073 | 10/1993 | Gross et al. | 355/221 |
| 5,272,507 | 12/1993 | Yoshida et al. | 355/225 |

*Primary Examiner*—R. L. Moses
*Assistant Examiner*—Sandra L. Brasé
*Attorney, Agent, or Firm*—Finnegan, Henderson, Farabow, Garrett & Dunner

[57] ABSTRACT

A corona discharge device includes a corona discharge electrode, and a control electrode interposed between the corona discharge electrode and a target object to be corona discharged for controlling a surface potential of the target object. The control electrode includes a film coating processed portion with a conductive dry film coating and an unprocessed portion with no film coating formed in at least one of two end portions of the control electrode in a longitudinal direction of the control electrode. The unprocessed portion of the control electrode has an opening ratio smaller than that of the film coating processed portion.

7 Claims, 4 Drawing Sheets

CORONA DISCHARGE DEVICE

BACKGROUND OF THE INVENTION

The present invention relates to a corona discharge device which applies static charges uniformly to the surface of a sensitive (photosensitive) material and, in particular, to a corona discharge device having a control electrode.

In recent years, an organic photosensitive material has been developed remarkably and has been used in many electronic photographic apparatuses. Most of the organic photosensitive material are used in a negative charged manner. As a corona discharge device which applies charges to the surface of a photosensitive material, in general, there are used a corotron and a scorotron having a control electrode. It is known that, when the corotron and scorotron are used in a negative polarity, a large amount of NOx (nitrogen oxides), ozone and the like are produced. Such NOx, ozone and the like facilitate the oxidation of the surface of the photosensitive material, the reduction of the electric resistance thereof, and the leakage of the charges on the surface thereof and, therefore, in images formed by use of the corotron and scorotron, there are found defects such as unsharp images, running images, white removed images and the like. To avoid this, there is taken a measure to attract the NOx, ozone and the like, which are produced from the corona discharge device when it performs corona discharge, out of the corona discharge device or to ventilate the corona discharge device. In parallel with the measure, there is proposed in Japanese Patent Unexamined Publication No. Hei 2-281274 a method of applying a substance into a case of a corona discharge device which can absorb or resolve the NOx, ozone and the like.

According to the method disclosed in the above Japanese Patent Publication, a thin conductive dry film (Electrodug (a trade mark) manufactured by Achison Corroid Co., U.S.A.), which is substantially continuous aluminum hydroxide film containing graphite particles and powder nickel, is coated to a shield, and the aluminum hydroxide of the coated film combines with nitrogen oxide or the like to form aluminum nitrate, thereby neutralizing the NOx.

However, the method or technology disclosed in the above Japanese Patent Publication has the following problems.

A control electrode can be produced, for example, by arranging grids each of 0.1 mm on a stainless steel frame having a thickness of 0.1 mm at an angle of 45° and at intervals of 1 mm by etching, while the control electrode has an opening ratio of about 90%. In a scorotron with such control electrode mounted thereto, a direct current (DC) voltage of −5500V is applied to the discharge electrode thereof, while a DC voltage of −580V is applied to the control electrode. If this scorotron is mounted to an electronic copying machine, then the dark potential (V-DDP) of a sensitive material becomes −600V. The BKG potential (V-BKG) of the sensitive material is set as −150V by controlling the quantity of light used to radiate a manuscript. In our test, this electronic copying machine was installed under the environment with the temperature of 10° C. and humidity of 30% and then a copying operation was carried out. After copying about 15,000 sheets and elaspe of one night, in a first copy, there occurred a white removal phenomenon which seemed to be caused by the discharge products of corotron. This phenomenon is caused in the following manner: That is, when a corona discharge device which has stopped discharge is laid in a rest condition for a long time, the NOx produced by corotron discharge and absorbed in the corotron is released to denature the surface of the photosensitive material being stopped opposed to the corona discharge device, and the denatured sensitive material surface portion causes the white removal phenomenon.

In view of this, when a coat (50 μm) of Electrodug (JD-29080, trade mark) manufactured by Achison Corroid Co., U.S.A. was applied to the front and back surfaces of the above-mentioned control electrode having the opening ratio of 90%, the opening ratio was changed to about 87%. When a DC voltage of −593V was applied to the control electrode, then the dark potential (V-DDP) of the sensitive material was changed to −600V. By use of this discharge electrode, a copying test was carried out under the same conditions. In this copying test, even after copying 20,000 sheets, no white removal occurred. However, after copying about 8,000 sheets, the densities of the two end portions of an image began to be deepen (this phenomenon is called a fog) and, after 13,000 copies, the densities of the two end portions reached a problem level.

When checking the variations of the BKG potential (see FIG. 10) and the variations of the sensitive material dark potential (see FIG. 11) in the axial direction of the photosensitive material in this case, the BKG potential is increased in the two end portions of the photosensitive material in the axial direction thereof when a trouble occurs, when the control electrode is replaced, and when the sensitive material is replaced, while the dark potential is increased in the two end portions of the photosensitive material in the axial direction thereof when a trouble occurs, and when the control electrode is replaced. Also, referring to the control electrode corresponding to the photosensitive material, similarly, the potentials of the two end portions of the control electrode in the longitudinal direction thereof are increased and the coated films of the control electrode corresponding to the potential increased portions were found insulated. In other words, if the control electrode is insulated, then an amount of corona ions flowing into the control electrode is reduced and an amount of corona ions flowing into the sensitive material is increased, with the result that the charged potential is increased, which is the fog phenomenon. Also, as the charged potential is increased, the density of the image is deepened, which is also the fog phenomenon. In this test, the dark potential (V-DDP) of the sensitive material was increased by 120V up to −720V.

In view of the above, the inventors tried to solve the fog phenomenon of the image by increasing the thickness of the coated film of the control electrode.

Three coats (90 μm) of Electrodug (JD-29080, trade mark) manufactured by Achison Corroid Co., U.S.A., were respectively coated onto the front and back surfaces of the control electrode having an opening ratio of 90%. The reason why the number of coatings is increased from 1 to 3 is that three coats are necessary to obtain a coat thickness of 90 μm because the film thickness varies greatly by thick coating. After the two films each of 90 μm were coated, the opening ratio of the control electrode was changed to about 85%. When a DC voltage of −610V was applied to the control electrode, then the dark potential (V-DDP) of the sensitive material was changed to −600V. Then, the discharge electrode was tested on the same conditions as above in copying. In this test, even after copying 50,000 sheets, no white removal phenomenon occurred. However, after about 25,000 copies, the two end portions of the formed image began to fog (that is, the densities of the two end portions thereof began to deepen) and, from 45,000 copies, the densities of the two end portions reached a problem level. In this case, the dark potential (V-DDP) of the sensitive material was −730V, which means that the dark potential was raised by 130V.

As described above, if the thickness of a coated film of the control electrode is increased, then the fogging of the two end portions of the image can be improved, but not yet perfect. Also, it is difficult to achieve the increase of the thickness of a coated film of the control electrode at a time and, in fact, there are necessary a plurality of coatings for this purpose, which incurs a problem of an increased cost.

As described above, in the conventional technology in which a film of a substance to absorb or resolve the NOx, ozone and the like is coated to the interior of a case of a corona discharge device, when the coated film of the control electrode is thin, then occurrence of a white removal phenomenon can be truly restricted but a greater secondary problem arises, that is, the two end portions of the image are fogged. To prevent the fogging phenomenon, it is necessary to increase the thickness of the coated film of the control electrode. However, our test shows that, even if the thickness of the coated film is increased, the fogging of the two end portions of the image occurs when the number of copies increases. Also, there arises another problem that the cost of the device is increased because it is necessary to increase the thickness of the coated material.

SUMMARY OF THE INVENTION

Accordingly, it is an object of the present invention to provide a corona discharge device which can solve the above-mentioned problems found in the conventional devices.

In attaining the above object, according to the present invention, there is provided a corona discharge device in which a control electrode interposed between a corona discharge electrode and a target object to be corona discharged (an object to which corona discharge is applied) for controlling the surface potential of the target object includes a film coating processed portion having a coated conductive dry film and an unprocessed portion disposed in at least one of the longitudinal end portions of the control electrode and having no coated film thereon.

Also, the unprocessed portion disposed in at least one of the end portions of the control electrode has a smaller opening ratio than the film coating processed portion.

The control electrode interposed between the corona discharge electrode and the target object to be corona discharged, is provided with a conductive dry film in the central portion of the control electrode through which NOx, ozone and the like pass in a large amount by a stream of ions generated in the corona discharging time, and the conductive dry film absorbs the NOx, ozone and the like. Since the longitudinal end portion of the control electrode into which the ion stream flows has no coated film thereon, the end portion prevents attachment of foreign matters and insulation due to the attachment of foreign matters, and also prevents a rise in the surface potential in the end portion of the target object to be corona discharged. Also, in an image forming device using a photographic mode, the opening ratio of the end portion of the control electrode is decreased so that the charged potentials of the sensitive material in the presence and absence of the coated film can be made equal to each other.

DETAILED DESCRIPTION OF THE PREFERRED EMBODIMENTS

Figure 1:
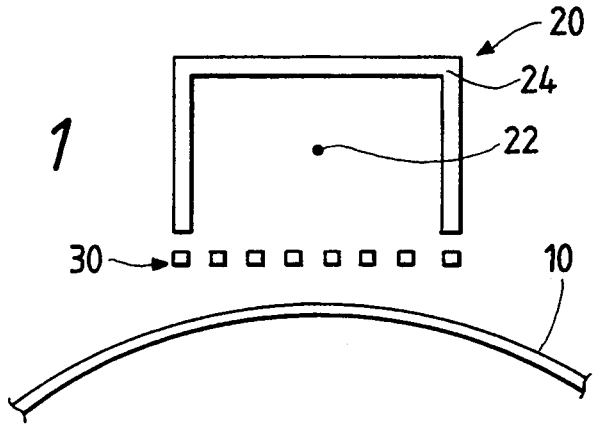
FIG. 1 is a general explanatory view of a corona discharge device which embodies the present invention.

Preferred embodiments of the present invention will be described with reference to the accompanying drawings.

Embodiment 1

FIGS. 1 to 4 are schematic views showing a basic structure of the corona discharge device according to the present invention. In these figures, a corona discharge device 20 includes in a discharger case 24 a discharge electrode (wire) 22 the two ends of which are provided in an end block 26, and the discharge electrode 22 is connected to a power supply 28. By applying a high voltage to the discharge electrode 22, corona jets are generated to thereby apply static charges to the surface of a sensitive material 10. In order to achieve more uniform charging, a control electrode 30 is interposed between the discharge electrode 22 and the sensitive material 10. The control electrode 30 comprises a control grid which is etched in a stainless steel plate at an angle of 45°. Alternatively, the control electrode may be of a screen which is composed of a plurality of wires, or a screen which can be made by forming holes in a plate. The control electrode 30 has the same polarity as the corona potential and is connected to the power supply 38. Normally, a potential of several hundreds of volts is applied to the control electrode 30 and this potential controls an electric field between the sensitive material 10 and the discharge electrode 22 to thereby reduce the flow of an ion current to the sensitive material 10.

The control electrode 30 is processed and coated with a conductive dry film of aluminum hydroxide containing graphite particles and powder nickel to thereby form a coated film 35.

However, as described hereinbefore in the problems found in the prior art, if the coated film 35 of the dry film of the control electrode is thin, then the white removal can be truly improved, but there arises a secondary problem that the two end portions of a copy are fogged.

In view of this, when changes in the sensitive material 10 and the control electrode 30 corresponding to the portions in which the fogging phenomenon occurs are checked, it is found that the charged potential of the sensitive material 10 corresponding to the fogged portion is increased and the coated film (dry film) 35 of the control electrode 30 corresponding to the fogged portion is insulated. Also, foregin matters such as silica and the like are found attached to the insulated portion of the control electrode coated film 35. Since silica and the like are not used in the corotron, it can be assumed that these foregin matters have entered from the outside of the corotron.

Figure 2:
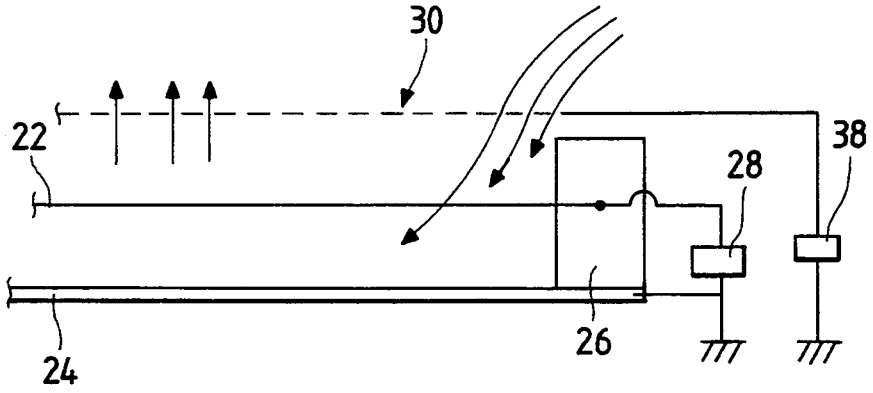
FIG. 2 is an explanatory side view of a corona discharge device which embodies the present invention.

That is, it is known that, when discharging, streams of ions produced due to corotron discharge and moving from the two end portions of the control electrode toward the central portion of the control electrode occur in such a manner as shown by arrows in FIG. 2. It is found from this that the ion streams are the causes of the denatured or stained film in the two end portions of the control electrode. That is, because the ion streams blow the foregin matters such as silica and the like into the corotron from the two end portions of the control electrode, the end portions of the control electrode are denatured or stained due to the foregin matters. Also, while most of the foregin matters coming from the outside of the corotron are attached to the two end portions of the control electrode, most of the NOx, ozone and the like produced in the corotron flow to the central portion of the control electrode but flow little to the two end portions thereof. The present invention was made by giving attention to this.

According to the present invention, the coated film 35 (coating of Electrodug, trade mark) for neutralization of the NOx and ozone is formed only on the longitudinal central portion of the control electrode 30 in which most of the NOx, ozone and the like are present. This aims at solving the problems found in the conventional corona discharge device.

Figure 3:
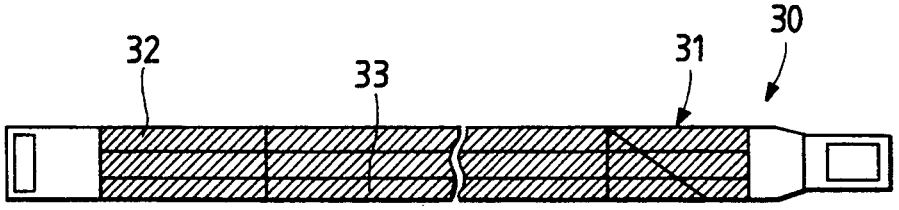
FIG. 3 is a plan view of a control electrode.
Figure 4:
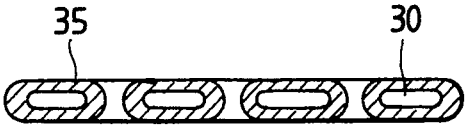
FIG. 4 is an explanatory view of a film coating processing part of the control electrode.

The control electrode 30 is formed by arranging a grid electrode of 0.1 mm on a stainless steel frame having a thickness of 0.1 mm at intervals of 1 mm and at an angle of 45°, and the control electrode 30 has an opening ratio of 90%. A scorotron, in which a DC voltage of −5500V is applied to the discharge electrode 22 and a DC voltage of −580V is applied to the control electrode 30, is mounted to an electronic copying machine. In this case, the dark potential (V-DDP) of the sensitive material 10 is −600V. The two longitudinal end portions 31 and 32 of the control electrode 30 are masked and two conductive dry films each of 50 μm in thickness, which is Electrodug (JD-29080, trade mark) manufactured by Achison Corroid Co., U.S.A., are coated onto the front and back surfaces of the control electrode 30 to thereby produce a film coating processed part 33. After the film coating processing, the opening ratio of the control electrode 30 is changed to about 87%. In order to change the sensitive material dark potential (V-DDP) of the central portion (film coating processed portion) 33 of the control electrode 30 to −600V, it was necessary to apply a DC voltage of −593V to the control electrode. In this case, the dark potential (V-DDP) of the sensitive material 10 corresponding to the unprocessed portions (20 mm) of the two end portions 31 and 32 of the control electrode 30 was −620V. In the present embodiment, the boundary portions between the film coating processed portion 33 of the electrode 30 and the unprocessed end portions 31 and 32, as shown in FIG. 3, were arranged in a tapered form which extends from one side edge of the control electrode 30 to the other side edge thereof in the width direction of the control electrode 30.

The discharge electrode constructed in the above manner was installed in a copying machine and the copying machine was tested on the copying operation thereof under the environment conditions that the temperature was 10° C. and humidity was 30%. Even after copying 60,000 sheets, neither white removal nor fogged end portions occurred. When the control electrode 30 was checked after 60,000 copies, the unprocessed portions of the two end portions 31 and 32 of the control electrode 30 were found discolored into yellow. The dark potential (V-DDP) of the sensitive material corresponding to the discolored portions were −660V, that is, the dark potential was increased by 40V (this means a potential difference of 60V with respect to the central portion of the sensitive material).

Although, in the present embodiment, the thickness of the conductive dry film was set to 50 μm, a proper thickness may be set for the conductive dry film, provided that it falls in a range of 50 μm to 100 μm.

Embodiment 2

In the embodiment 1, from the initialization of the operation, the potential of the unprocessed portions of the two longitudinal end portions 31 and 32 of the control electrode 30 is higher by about 20V when compared with the film coating processed portion 33 existing in the central portion of the control electrode 30. In a normal copy mode, a potential difference of the order of 50V provides no problem. However, as in a photographic mode, when the dark potential (V-DDP) of the sensitive material is lowered greatly (by −200V or so), even the potential difference of the order of 50V results in a density difference on a copy, which provides a problem. In view of this, in a corona discharge device according to the embodiment 2, the opening ratio of the two end portions of the control electrode are lowered down and the potential of the sensitive material is also lowered down so that an image formed in a photographic mode can have the same density in the end portions thereof corresponding to the two longitudinal end portions of the control electrode and in the portion thereof corresponding to the central portion of the control electrode.

Figure 5:
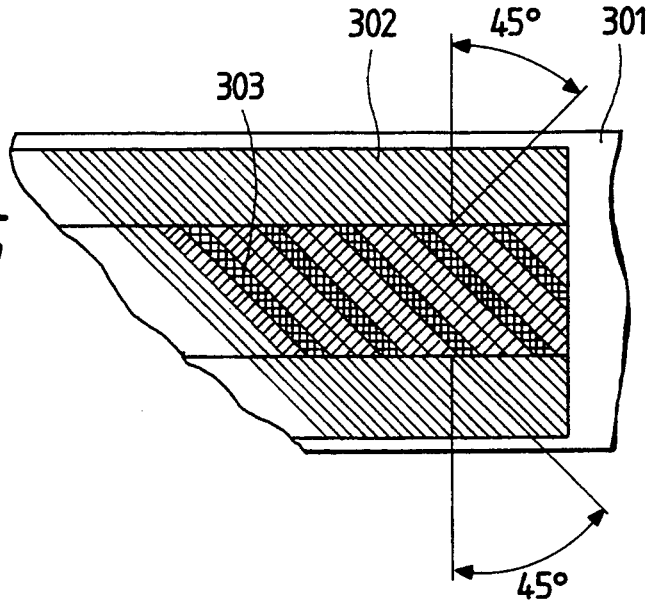
FIG. 5 is an enlarged view of an end portion of the control electrode, showing the formation of an electrode in the end portion.

In other words, the discharge current of the corotron discharge electrode 22 is the highest at the top portion of the electrode 22 and becomes lower as it goes away from the electrode top portion. In view of this fact, control electrode grids to be provided in a central portion 303 in the width direction of two end portions 302, that is, in the unprocessed portions of a control electrode 301 corresponding to the corotron discharge electrode 22 are increased in number to thereby lower the opening ratio thereof, so that, in a photographic mode, the two end portions 302 have the same density in copying as the longitudinal central portion, that is, the film forming portion of the control electrode 301. For example, as shown in FIG. 5, grid electrodes, which are respectively inclined left at an angle of 45° in FIG. 5, are increased in addition to grid electrodes which are inclined right in FIG. 5, thereby forming the central portion 303.

As described above, the problem of a density difference between the boundary portions of the film coating processed portion and unprocessed portion of the control electrode 301 in the photographic mode can be improved by lowering the control electrode opening ratio of the no film coated portion (the unprocessed portion) below that of the film coated portion (film coating processed portion) to thereby uniform the sensitive material potential.

When the present discharge electrode was tested on copying under the same conditions as the embodiment 1, even after copying 100,000 sheets, no white removal occurred nor the two end portions were fogged. Also, even in the photographic mode, no problem arose. After copying 100,000 sheets, when the control electrode 301 was checked, the unprocessed portions 302 of the two end portions thereof were found discolored into brown. The dark potential (V-DDP) of the sensitive material corresponding to these portions was −660V, which shows that the dark potential was raised by 60V.

Embodiment 3

In the embodiment 2, in order to change the opening ratio of the end portions of the control electrode, the control electrode grids in the central portion in the width direction of the control electrode end portion, which corresponds to the discharge electrode and is the unprocessed portion where no film is coated, are increased in number to thereby make denser the pattern of the grid electrode. In the present embodiment 3, the opening ratio of the control electrode end portions is changed by changing the pitch of the pattern of the grid electrode.

Figure 6:
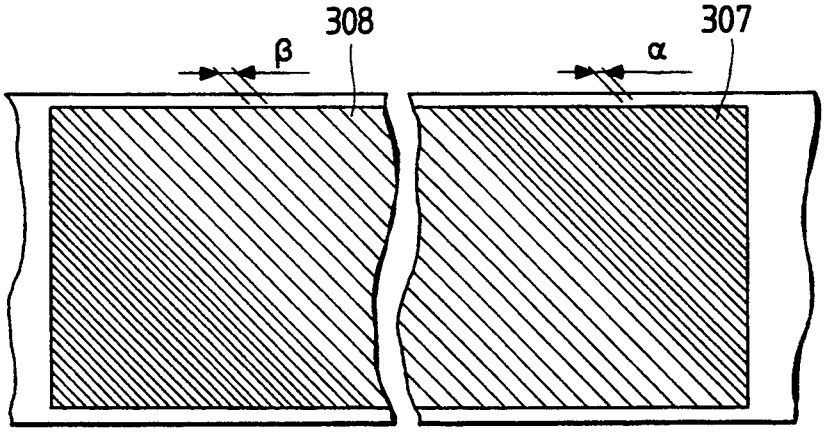
FIG. 6 is an enlarged view of another embodiment of the formation of an electrode in the end portion of the control electrode.

In other words, the pitch $\beta$ of the grid electrode of the central portion (film coating portion) 308 is set with respect to the pitch $\alpha$ of the grid electrode of the end edge portion (unprocessed portion) 307 in such a manner that $\alpha=0.9$ mm, $\beta=1.00$ mm, thereby increasing the opening ratio (see FIG. 6).

If the corona discharge device is formed in this manner, then the copy density difference in the film coating processed boundary portions between the film coating processed portion 308 and unprocessed portion 307 of the control electrode is hard to occur and the opening ratio of the end portions of the control electrode is easy to set.

Figure 7:
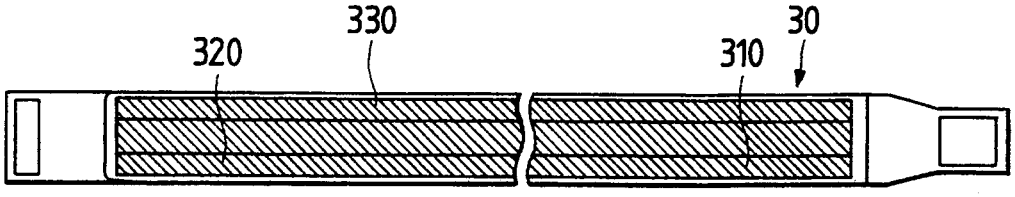
FIG. 7 is an explanatory view of another embodiment of the film coating processing part of the control electrode.

Further, the oblique boundary lines, which point out boundaries between the film coating processed portion 330 in the longitudinal central portion of the control electrode and the unprocessed portions 310 and 320 of the control electrode, are not inclined in the mutually opposing direction but, as shown in FIG. 7, are inclined in the same direction in such a manner that the two longitudinal end portions of the boundary lines are parallel to each other. When coated films are formed into this shape, the copy density difference due to the variations of the boundary portions between the film coating processed portion 330 and the unprocessed end portions 310 and 320, is more difficult to occur. Further, since the fewer and smaller problems arise in the image quality when the density difference in the boundary portions of the control electrode forming pattern is lower than that in the neighboring portions, it is preferred that the boundaries of the film coating processed portion are provided in the two end portions having the low opening ratio. Actually, the unprocessed portions of the control electrode are formed so as to have a length of 30 to 31.5 mm.

In the embodiments described hereinbefore, as the conductive dry film of the control electrode, there is used a substantially continuous, thin, conductive and dry film which is formed of aluminum hydroxide containing graphite particles and powder nickel. However, the present invention is not limited to this dry film, but other films can also be used, which can neutralize ozone and NOx, for example: (1) a conductive dry coating film formed of alkali metal silicate and conductive particles (graphite); and, (2) a conductive dry coating film formed of aluminum hydroxide containing conductive particles (graphite). Further, to perform film coating process on the control electrode, there can be used other catalytic materials such as nickel plating, silver oxide or the like which can resolve O.

Figure 8:
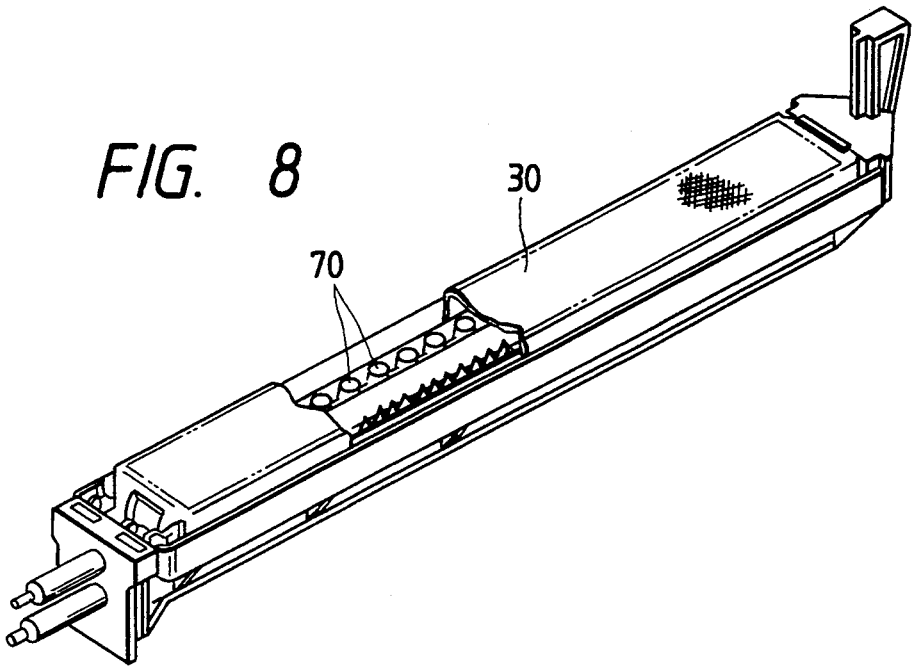
FIG. 8 is a perspective view of another embodiment of a corona discharge device according to the present invention.
Figure 9:
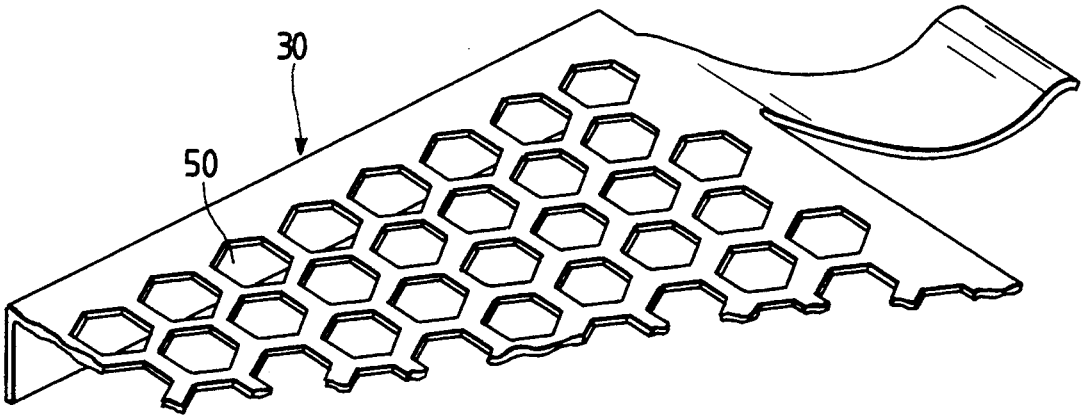
FIG. 9 is a perspective view of another embodiment of a control electrode employed in the present invention.
Figure 10:
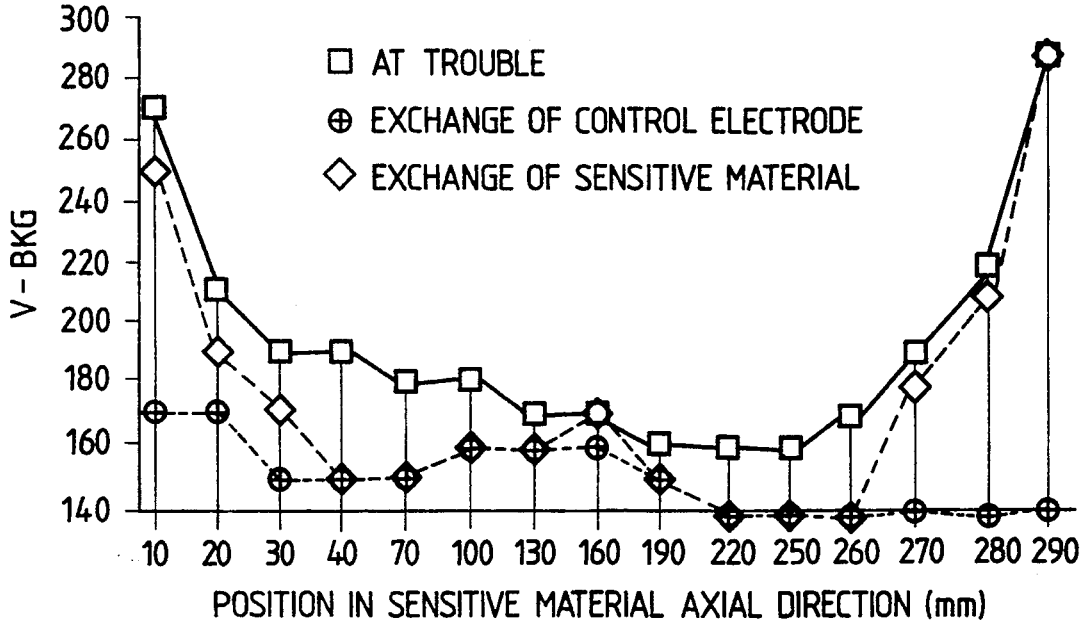
FIG. 10 is a graphical representation of variations in the BKG potential of the sensitive material in the axial direction thereof.
Figure 11:
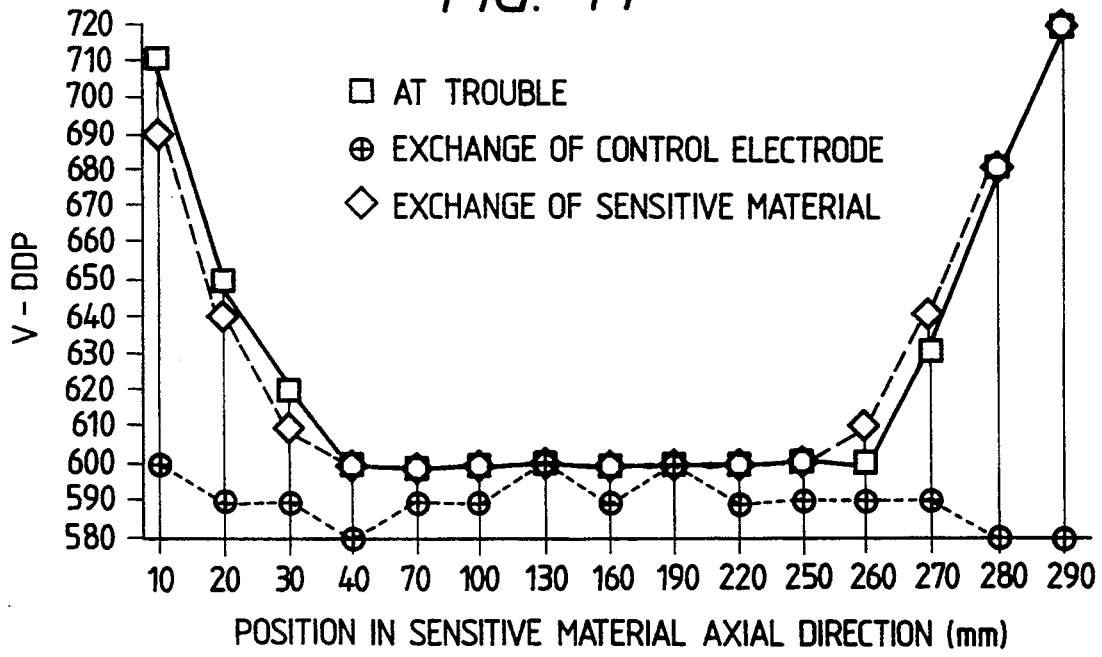
FIG. 11 is a graphical representation of variations in the dark potential of a sensitive material in the axial direction thereof.

Also, the discharge electrode of the corona discharge device may not be formed of a wire but, as shown in FIG. 8, it may be formed so as to include a pin electrode 70. Further, the electrode pattern of the control electrode 30 is not limited to the linear pattern and grid pattern, but a hexagonal pattern 50 can also be used (see FIG. 9).

Since the present invention is structured in the above-mentioned manner, NOx (nitrogen oxide) and ozone produced in the corona discharge device can be absorbed by a film coated in the longitudinal central portion of a control electrode by means of an ion wind or an ion stream which occurs in the corona discharge. Also, due to the fact that the longitudinal end portions of the control electrode are not subjected to film coating process, even if the external air is blown in by ion streams, the end portions are not contaminated and thus are not insulated by such contamination contrary to the conventional corona discharge device. Therefore, even if the number of times of corona discharge becomes large, there can be eliminated the possibility that the potential of a sensitive material is raised in the end portions thereof, so that the fogging phenomenon does not occur in the formed image even if the number of times of copying is increased. As a result of this, the formed image does not become dark in part and an image can be formed with high accuracy.

Also, when a high gradation is required as in a photographic mode, the two longitudinal end portions of a control electrode in which no film coating process is performed, are formed denser to thereby lower the opening ratio thereof, whereby discharge to the sensitive material corresponding to the film coated portion of the longitudinal central portion of the control electrode can be made equal to discharge to the other portions of the control electrode, so that the density of an image formed can be made uniform.

What is claimed is:

1. A corona discharge device, comprising:

a corona discharge electrode; and a control electrode interposed between said corona discharge electrode and a target object to be corona discharged, said control electrode controlling a surface potential of said target object;

wherein said control electrode comprises a film coating processed portion with a conductive dry film coating and an unprocessed portion with no film coating, and said unprocessed portion of said control electrode is disposed in at least one of two end portions of said control electrode in a longitudinal direction of said control electrode.

2. A corona discharge device as set forth in claim 1, wherein said control electrode has a smaller opening ratio of electrode pattern at said two end portions of said control electrode than at a central portion of said control electrode on which said film coating is provided, and boundary lines between said unprocessed portion and said film coating processed portion are located in said end portions having the smaller opening ratio.

3. A corona discharge device, comprising:

a corona discharge electrode; and a control electrode interposed between said corona discharge electrode and a target object to be corona discharged, said control electrode contorting a surface potential of said target object;

wherein said control electrode comprises a film coating processed portion with a conductive dry film coating and an unprocessed portion with no film coating formed in at least one of two end portions of said control electrode in a longitudinal direction of said control electrode; and said unprocessed portion of said control electrode has an opening ratio smaller than that of said film coating processed portion.

4. A corona discharge device as set forth in claim 3, wherein said control electrode is formed of grid electrodes, a density of said grid electrodes of said unprocessed portion being denser than that of said film coating processed portion so that said opening ratio of said unprocessed portion is smaller than that of said film coating processed portion.

5. A corona discharge device as set forth in claim 3, wherein said control electrode is formed of grid electrodes, a pitch of said grid electrodes of said unprocessed portion being smaller than that of said film coating processed portion so that said opening ratio of said unprocessed portion is smaller than that of said film coating processed portion.

6. A corona discharge device as set forth in claim 1 or 3, wherein a boundary line between said film coating processed portion and said unprocessed portion of said control electrode is inclined with respect to a longitudinal direction of said control electrode.

7. A corona discharge device as set forth in claim 1 or 3, wherein boundary lines at said two end portions between said film coating processed portion and said unprocessed portion of said control electrode are inclined in such a manner that they are parallel to each other.

* * * * *

UNITED STATES PATENT AND TRADEMARK OFFICE

CERTIFICATE OF CORRECTION

PATENT NO. : 5,351,111

DATED : September 27, 1994

INVENTOR(S) : Akihiro TAKAFUJI et al.

It is certified that error appears in the above-indentified patent and that said Letters Patent is hereby corrected as shown below:

Claim 3, Column 9, Line 21 change "contorting" to --controlling--.

Signed and Sealed this

Twenty-eight Day of March, 1995

*Attest:*

Bruce Lehman

BRUCE LEHMAN

*Attesting Officer*

*Commissioner of Patents and Trademarks*